US007581509B2

(12) United States Patent
Eventoff

(10) Patent No.: US 7,581,509 B2
(45) Date of Patent: Sep. 1, 2009

(54) HYBRID WHISTLE

(75) Inventor: Franklin Eventoff, Bow, WA (US)

(73) Assignee: Search & Rescue Products, LLC, Higley, AZ (US)

( * ) Notice: Subject to any disclaimer, the term of this patent is extended or adjusted under 35 U.S.C. 154(b) by 0 days.

(21) Appl. No.: 11/489,071

(22) Filed: Jul. 18, 2006

(65) Prior Publication Data

US 2008/0017097 A1 Jan. 24, 2008

(51) Int. Cl.
*G10K 5/00* (2006.01)

(52) U.S. Cl. ..... 116/137 R; 446/216

(58) Field of Classification Search ..... 116/137 R; 446/202, 203, 204, 205, 216; D10/119
See application file for complete search history.

(56) References Cited

U.S. PATENT DOCUMENTS 632,184 A * 8/1899 Johnson ..... 446/206
696,814 A * 4/1902 Hatch ..... 446/206
2,454,105 A * 11/1948 Thompson ..... 446/206
2,833,086 A * 5/1958 Johenning ..... 446/202
4,709,651 A * 12/1987 Lance ..... 116/137 R
4,779,568 A * 10/1988 Finger, Jr. ..... 116/137 R
4,821,670 A * 4/1989 Foxcroft et al. ..... 116/137 R
5,086,726 A * 2/1992 Sharp ..... 116/137 R
5,113,784 A * 5/1992 Forselius ..... 116/137 R
5,251,569 A * 10/1993 Seron ..... 116/137 R
5,546,887 A * 8/1996 Cameron ..... 116/137 R
5,816,186 A * 10/1998 Shepherd ..... 116/137 R
D410,771 S * 6/1999 Chang ..... D3/208
5,975,007 A * 11/1999 Cross ..... 116/137 R
D433,340 S * 11/2000 Lo ..... D12/2
D502,421 S * 3/2005 Cheng ..... D10/119
6,975,213 B2 * 12/2005 Wang ..... 340/328
2003/0033970 A1 * 2/2003 Hills et al. ..... 116/137 R
2003/0116078 A1 * 6/2003 Topman et al. ..... 116/137 R
2005/0068158 A1 * 3/2005 Wang ..... 340/326
2005/0148280 A1 * 7/2005 Primos et al. ..... 446/404
2005/0237736 A1 * 10/2005 Wimsatt ..... 362/196

* cited by examiner

*Primary Examiner*—R. Alexander Smith
(74) *Attorney, Agent, or Firm*—Roy L Anderson; Wagner, Anderson & Bright, LLP

(57) ABSTRACT

A hybrid whistle has two pealess whistle chambers with air vents to the left and right and a central pea whistle with an air vent facing generally perpendicularly to the left and right air vents that are integrally formed together, preferably in a two piece, top and bottom, construction. The hybrid whistle has a mouthpiece with a left air opening, a central air opening and a right air opening, each of which is connected to its respective whistle chamber by an air passageway. The three whistle chambers produce differing whistle pitch sounds as air flows through them and out the chambers' exits. The central pea whistle has a barrel chamber with a pea block formed within it so as to modify the barrel shape of the chamber and block the air flow as the pea circulates in the air current causing a staccato effect, while creating enough circulating air movement to prevent the pea from getting stuck in the vent by the air as it exits out of the central air exit when the whistle is blown. A second pea whistle can be added to the hybrid whistle.

18 Claims, 10 Drawing Sheets

HYBRID WHISTLE

FIELD OF THE INVENTION

This invention is in the field of whistles, and more particularly, in the field of whistles used for emergency situations.

BACKGROUND OF THE INVENTION

Whistles have been known in the art for a long time, and have many varied uses, including use at sporting events, or for signaling or emergency uses. The simplest whistles have a single chamber and either use a pea or are pealess, but emit a single tone.

Over time, various improvements have been suggested to the basic design of whistles. For example, in U.S. Pat. No. 4,709,651, a whistle is disclosed that uses two different chambers formed within a single body having a single mouthpiece. The chambers are of different dimensions, so that each chamber generates a different sound.

In U.S. Pat. No. 4,821,670, it is suggested that a whistle with improved volume and audibility can be obtained by using at least two elements disposed side-by-side to one another in a pealess whistle. However, as is noted in this patent, the whistle uses a "relatively complex structure" that is manufactured by using a three-part plastic molding. (See Col. 4, line 56 through column 5, line 42.)

In U.S. Pat. No. 5,251,569, a multiple tone whistle is disclosed which has an object of its invention to provide a new and improved multiple tone whistle that lends itself to easy manufacturing techniques. This patent discloses a whistle with two different whistle chambers that can be altered to change pitch.

In U.S. Pat. No. 5,546,887, an emergency whistle is disclosed that uses two side-by-side chambers, with peas, to create two different pitches, one high, one low.

Thus, while whistles have been known in the art for a long time, there is a constant need for improvement, especially when whistles are used in emergency situations. In fact, when whistles are used in emergency situations, their performance can be a matter of life and death. Accordingly, the present invention seeks to add to the existing art by disclosing an improved hybrid whistle, which utilizes some of the best features and advantages of both pea and pealess whistle technology, in a single whistle that can be manufactured at a reasonable cost, while still providing a reliable whistle for emergency use situations in which multiple pitches and the quality of sound produced can have serious consequences.

SUMMARY OF THE INVENTION

The present invention is generally directed to a hybrid whistle that has two pealess whistle chambers with air vents to the left and right and a central pea whistle with an air vent facing generally perpendicularly to the left and right air vents that are integrally formed together, preferably in a two piece, top and bottom, construction. The hybrid whistle has a mouthpiece with a left air opening, a central air opening and a right air opening, each of which is connected to its respective whistle chamber by an air passageway. The three whistle chambers produce differing whistle pitch sounds as air flows through them and out the chambers' exits. The central pea whistle has a barrel chamber with a pea block formed within it so as to modify the barrel shape of the chamber and prevent the pea from blocking air flow out of its air exit when the whistle is blown.

In a first, separate group of aspects of the present invention, the mouthpiece of the whistle has a concave shape and a rubber overmolding is fitted to it, while the pea can be made of a synthetic cork material. A recessed logo space can be molded in the top of the whistle to hold an insert secured by a bezel, which can include printed material, and a keyhole for a key ring can run through the whistle and the insert. A molded underside cavity in the whistle can be fitted to hold a second insert, a compass or even a light emitting diode flashlight.

In another aspect of the present invention, a second pea whistle can be added to the hybrid whistle.

Accordingly, it is a primary object of the present invention to provide an improved whistle that is useful for emergency situations.

These and further objects and advantages will be apparent to those skilled in the art in connection with the drawings and the detailed description of the invention set forth below.

BRIEF DESCRIPTION FOR THE DRAWINGS

DETAILED DESCRIPTION OF THE INVENTION

Figure 1:
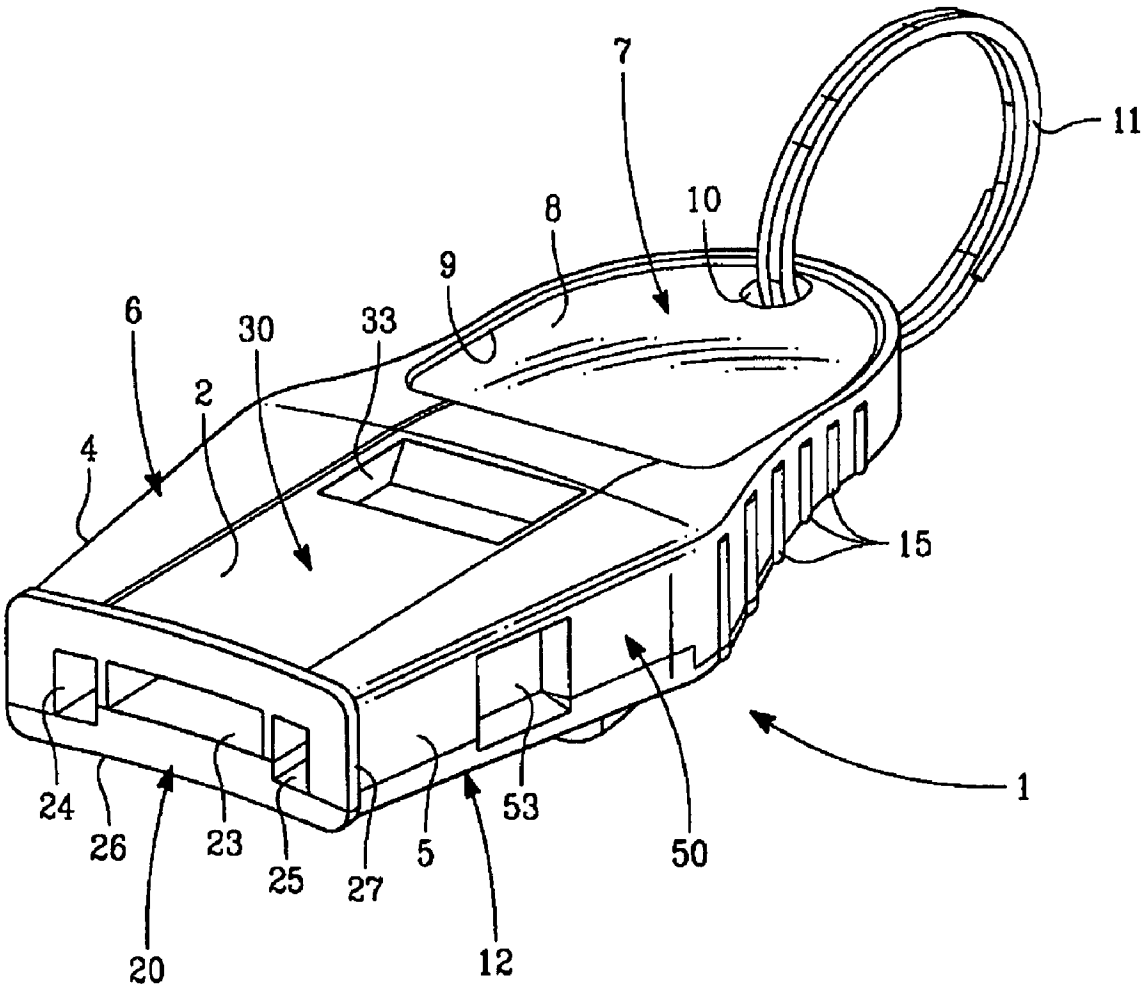
FIG. 1 is a top planar view of a whistle in accordance with the present invention.
Figure 2:
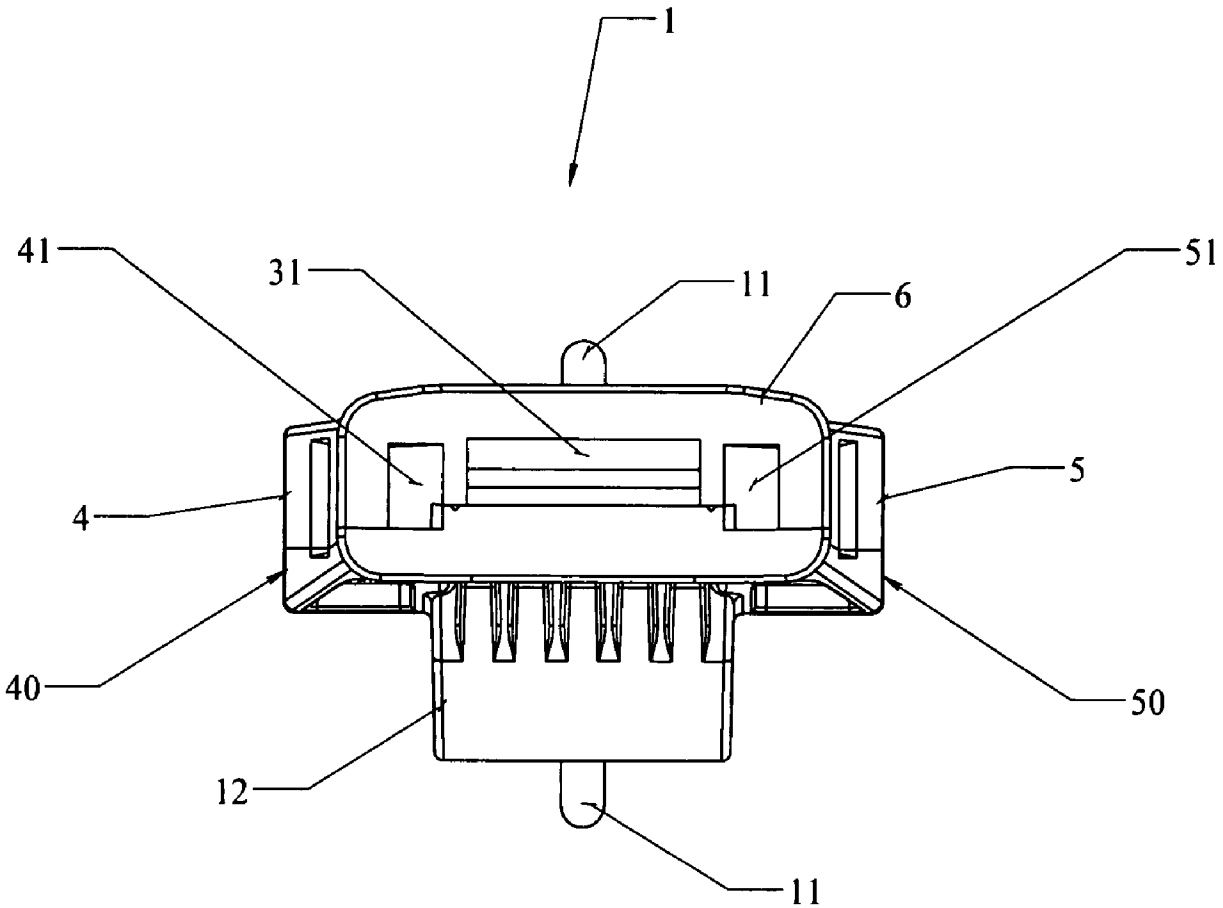
FIG. 2 is a rear side view of a whistle in accordance with the present invention.
Figure 3:
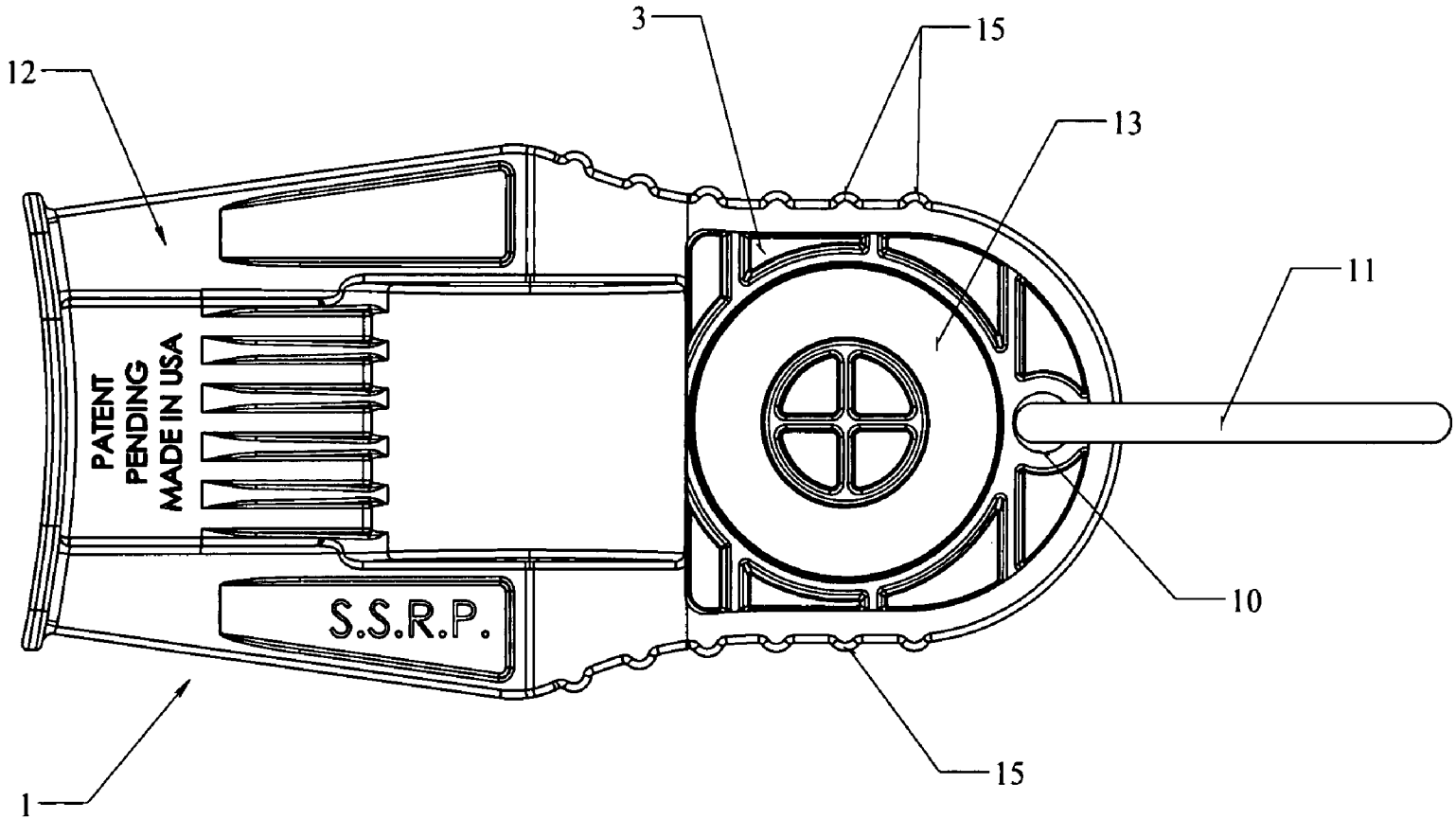
FIG. 3 is a bottom planar view of a whistle in accordance with the present invention.
Figure 4:
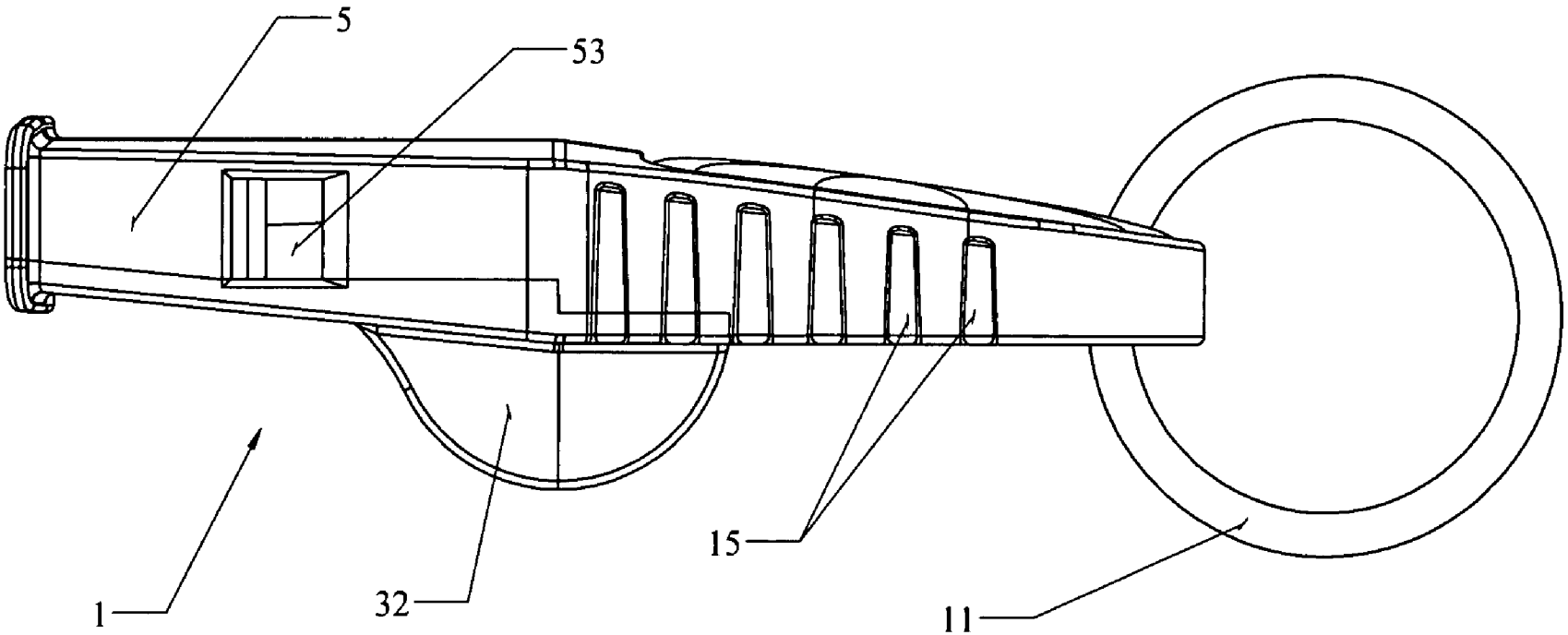
FIG. 4 is a right side view of a whistle in accordance with the present invention.
Figure 5:
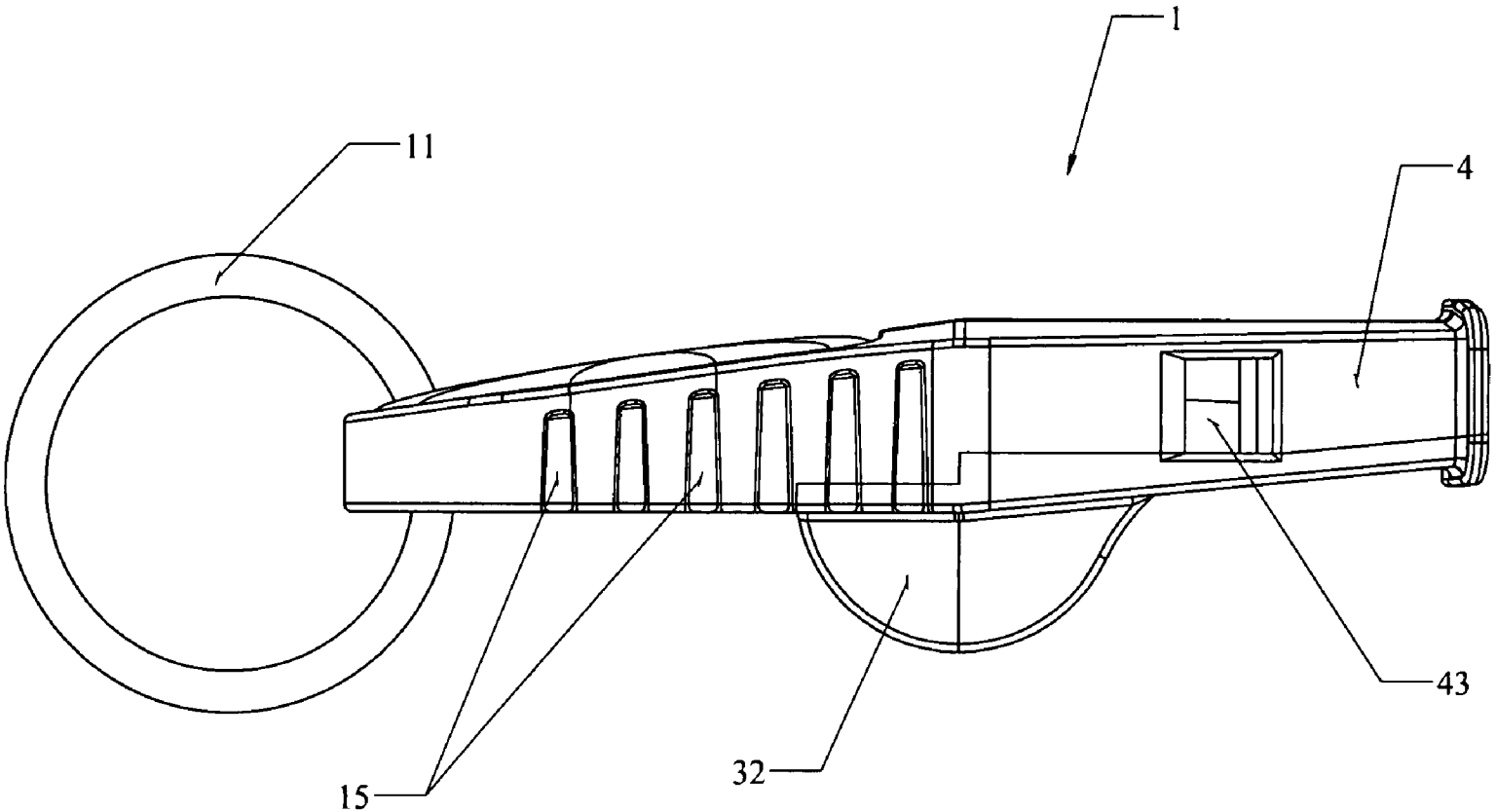
FIG. 5 is a left side view of a whistle in accordance with the present invention.
Figure 6:
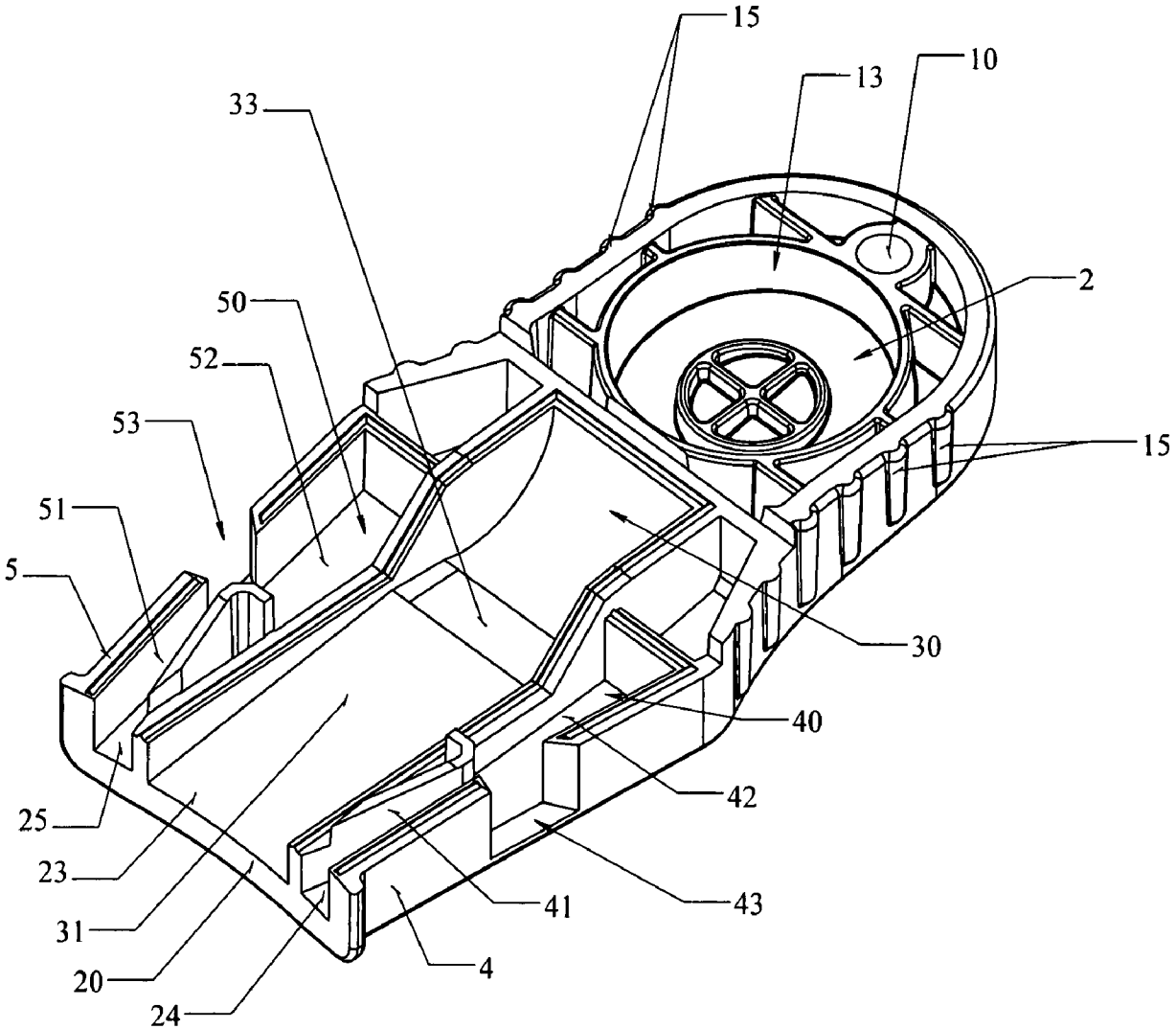
FIG. 6 is a planar view of a top molded construction of a whistle in accordance with the present invention, looking at the inside of the piece.
Figure 7:
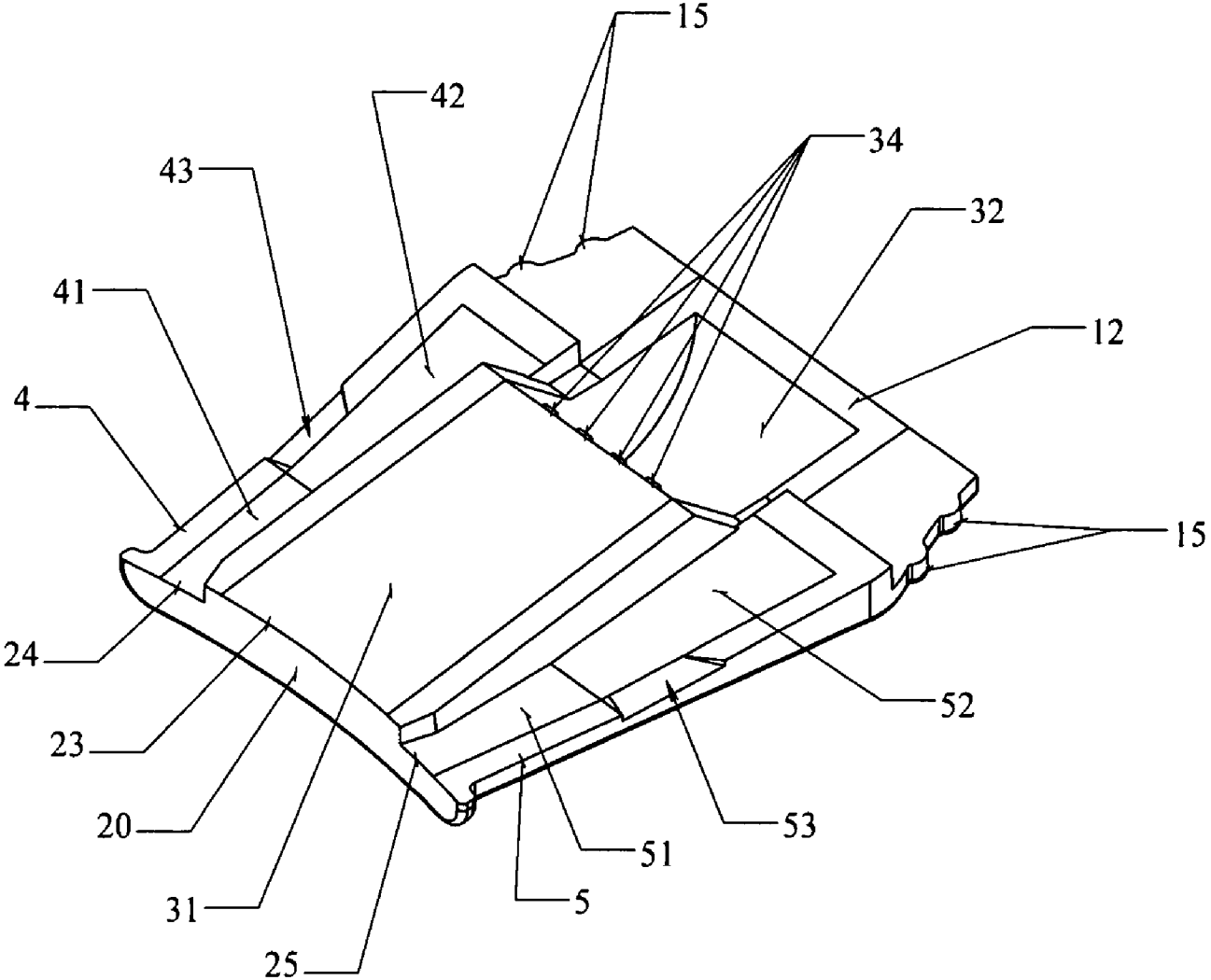
FIG. 7 is a planar view of a bottom molded construction of a whistle in accordance with the present invention, looking at the inside of the piece.

In accordance with an especially preferred embodiment of the present invention, a hybrid whistle 1 is disclosed that combines both a pealess whistle chamber and a pea whistle chamber. The hybrid whistle 1, which is shown in FIGS. 1-9, has a central pea whistle 30, a left pealess whistle 40 and a right pealess whistle 50 that are constructed from a two-piece molding process. Although not shown, the present invention also contemplates adding a second pea whistle chamber between the left and right pealess whistles 40 and 50. Also, although the following discussion refers to pealess whistles and a pea whistle chamber, such "whistles" are not separate whistles per se, but part of one hybrid whistle which, when blown, derives its whistle signal from the combination of its various outputs. Although the drawings are described in greater detail below, the following is a glossary of elements shown in FIGS. 1-9:

1 hybrid whistle
2 top planar area
3 bottom planar area
4 left side
5 right side

6 top molded construction
7 recessed logo space
8 insert
9 bezel
10 key hole
11 key ring
12 bottom molded construction
13 molded underside cavity
15 ribs
20 mouthpiece
23 central air opening
24 left air opening
25 right air opening
26 concave shape of mouthpiece
27 rubber overmolding
30 central whistle
31 central air passageway
32 central whistle barrel chamber
33 central exit vent
34 pea block
40 left whistle
41 left air passageway
42 left air whistle chamber
43 left air exit vent
50 right whistle
51 right air passageway
52 right air whistle chamber
53 right air exit vent Hybrid whistle 1 is constructed of a top molded construction 6 and a bottom molded construction 12 removed from molds so that the whistle is separated into a top molded construction 6 and a bottom molded construction 12 (see FIGS. 6 and 7), instead of left and right halves, and the top and bottom constructions 6 and 12 are not symmetrical. In other words, top and bottom constructions 6 and 12 are not mirror images of each other.

In addition to portions of their construction that form the various whistles, as shown in FIG. 1, top molded construction 6 has a recessed logo space 7 in its top planar area 2 into which an insert 8, which may be made of plastic, is inserted, typically during the assembly process, and which can be held in place by bezel 9 formed in top molded construction 6. The insert 8, top molded construction 6 and bottom molded construction 12 all have a key hole 10 for holding a key ring 11. By making sure that insert 8 also has a key hole through which key ring 11 is inserted, insert 8 is also secured by the key ring. Insert 8 can include a logo or advertising material, and thus lends itself to customization of the hybrid whistle due to printed matter. Bottom molded construction 12 has a molded underside cavity 13 in bottom planar area 3 which can also be used for an insert (not shown) that may be a second advertising insert, or it can conveniently be a compass or flashlight, or some other small device that might be advantageously included with the whistle, such as a thermometer, altimeter, watch, etc. Hybrid whistle 1 also has ribs 15 for gripping and ornamentation.

Once the top and bottom constructions 6 and 12 are assembled, a mouthpiece 20, which has an ergonomic concave shape 26, has a central air opening 23 that leads into the central pea whistle 30 by central air passageway 31, a left air opening 24 that leads into left pealess whistle 40 by left air passageway 41 and a right air opening 25 that leads into right pealess whistle 50 by right air passageway 51. Mouthpiece 20 can also have a rubber overmolding 27 which offers the advantages of assuring a seal around the mouthpiece, it avoids freezing, it does not absorb moisture, it is not hard on teeth, it provides a sure-hold grip, it prevents the hybrid whistle from sliding (e.g., off a dashboard) and it serves as a shock absorber to help prevent breakage when the whistle is dropped.

Figure 8:
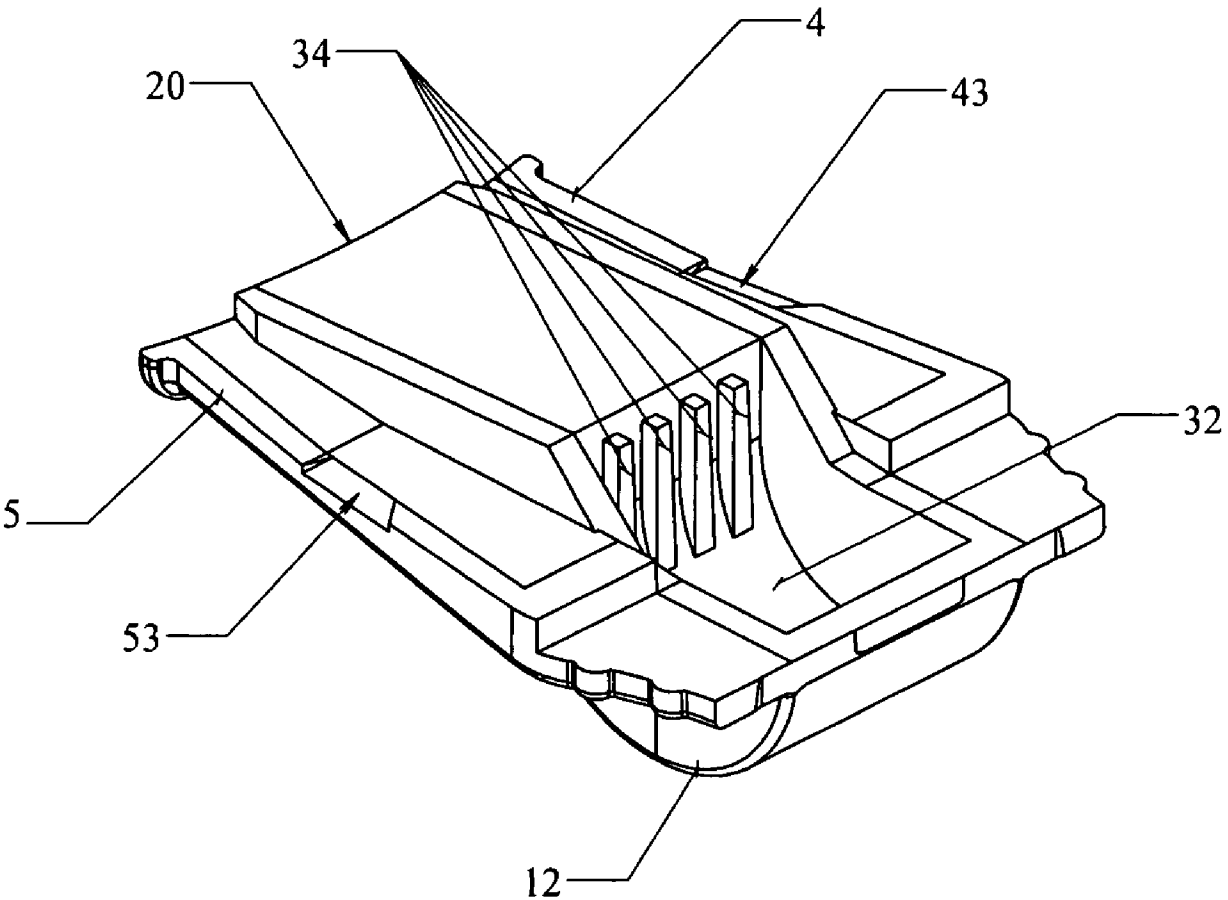
FIG. 8 is a planar view of the bottom molded construction of FIG. 7 at a different angle.
Figure 9:
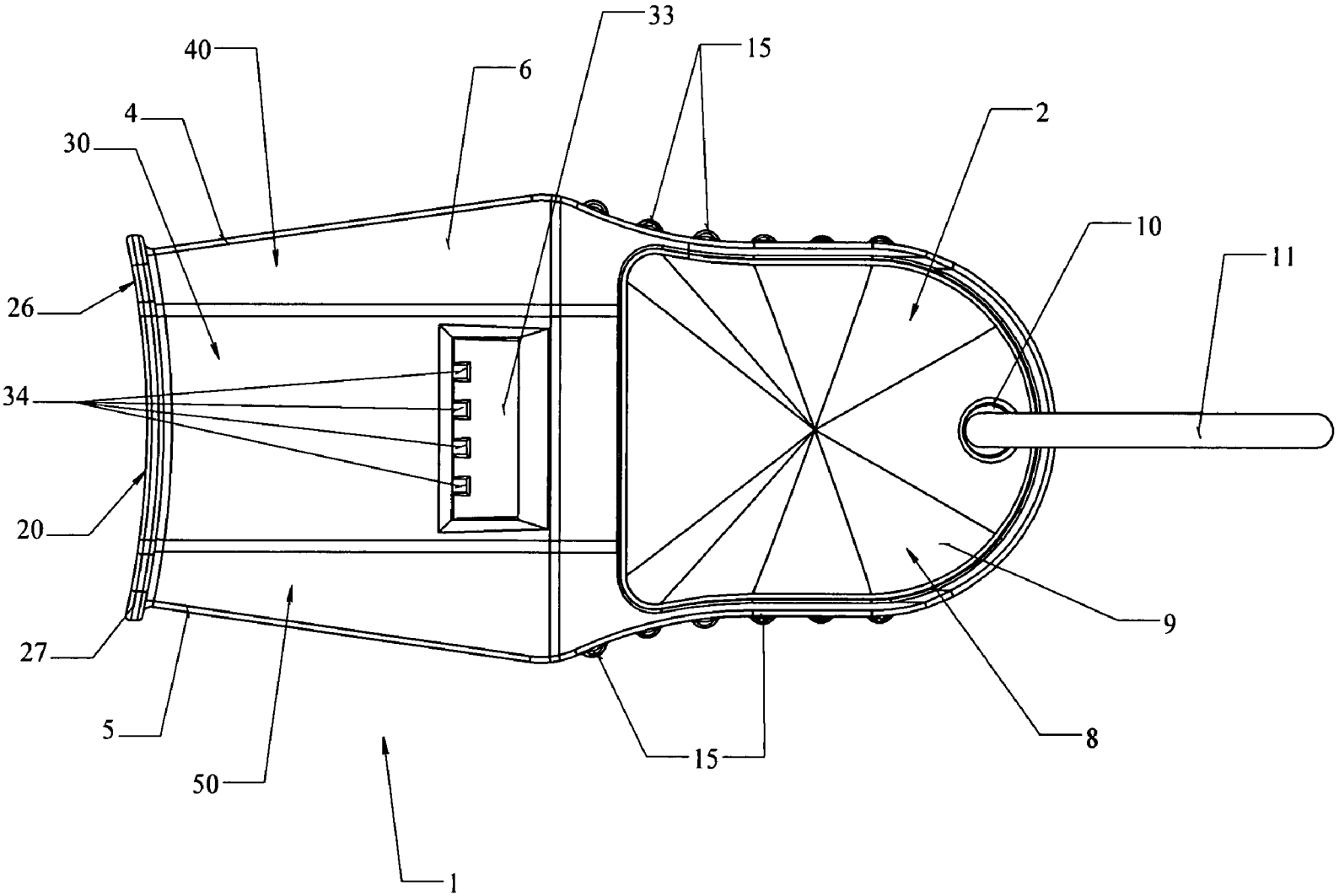
FIG. 9 is another top planar view of a whistle in accordance with the present invention.

Central pea whistle 30 has a central whistle barrel chamber 32, a central exit vent 33 and a pea block 34. In a traditional barrel chamber whistle, an undercut is used to prevent the pea from becoming stuck in the air vent by creating an eddy that pushes the pea past the vent. The undercut is possible because tools for common mold designs pull apart from side to side. However, because the present invention adds a left and right pealess whistle, the top and bottom molded constructions are pulled apart from top to bottom, and an undercut solution is not possible unless a complex injection mold tool is used, which will greatly increase the cost. To prevent the pea from getting stuck in central exit vent 33 when hybrid whistle 1 is blown, a pea block 34 is included in the central barrel whistle chamber to keep the pea from being positioned in such a way as to get stuck in the air vent when the hybrid whistle is blown hard. The pea block alters the traditional geometry of the barrel chamber so that rotation of the pea takes place away from the exit vent. As shown in FIG. 8, pea block 34 can be a series of blocks or ridges that limit movement of the pea inside of what would otherwise be a traditional barrel chamber.

Left pealess whistle 40 has a left air whistle chamber 42 and a left air exit vent 43 while right pealess whistle 50 has a right air whistle chamber 52 and a right air exit vent 53. Left and right air exit vents 43 and 53 vent air in opposite directions from each, both of which are essentially at substantially right angles to central exit vent 33, in the left side 4 and right side 5, respectively. This creates an airflow situation in which air exiting hybrid whistle 1 travels outwardly substantially 180 degrees from a plane that is perpendicular to air being blown into whistle 1, while air leaving central exit vent 33 leaves the same plane substantially 90 degrees between each of the left and right air exit vents 43 and 53. It has been found that this airflow configuration greatly increases both the loudness and the ability of the whistle signal to carry over distances in an emergency or rescue situation, although it is possible that angles $\alpha$ and $\beta$ (see FIG. 10) of less than ninety degrees for the left and right air vents in the resultant hybrid whistle may also work to create a whistle signal that is "omnidirectional" for ultimate multi sounds for a rescue, lifesaving and signaling device. Also, because one chamber is a pea whistle, this chamber produces a loud staccato crack that defines the combined whistle signal over noises such as wind, water and canyon noises, thus giving the whistle signal a full spectrum of sound.

The characteristics of the various whistle chambers can be adjusted, based upon designer choice, to customize the resultant whistle signal, both in terms of loudness and pitch. The customization can take place not only as between which chambers have peas and which do not, and how many such chambers there are, but also the dimensions of the chambers and the characteristics of any peas can be varied. Thus, different pitches may be obtained from the left and right whistle chambers, and these may be made either higher or lower than the pitch from any central whistle chamber. In experimental testing, it has been found that an extremely robust whistle signal is obtained when the left and right whistle chambers have differing pitches which are higher than the pitch of one or more central whistle barrel chambers (such chamber(s) being "central" in that it is between the outer left and right whistles and the exit vents direct airflow out in different directions, as already discussed); also, by making the left and right pealess whistle chambers out of pitch with one another, it has been found that this creates a beating effect analogous to the staccato effect of a pea whistle. In addition, as already noted, the size and type of "pea" used in one or more pea whistles may be varied. Generally speaking, by changing the density of the pea, the cadence can be changed, and the heavier the pea, the slower the cadence of the staccato. A hi-density foam pea will resist oil, gas, and chemicals and will not absorb water or freeze, or the pea may be made of a synthetic cork, such as the type of material that is used in many wine bottles today (e.g., the material might be made of EBS or EBA or ethyl vinyl acetate, or perhaps polyethylene or polypropylene). Also, if desired, special whistles could be used to identify locations of various search and rescue personnel, giving a specific signature to each whistle.

The top and bottom molded constructions 6 and 12 are preferably made of highest grade ABS plastic that will withstand 70 degrees F. below zero temperature without getting brittle, fracturing, or breaking the plastic. The parts can also be made with nylon and reinforced fiberglass for superior strength. By using such construction, it has been found that a hybrid whistle can be constructed that will still function even after it has been driven over by a truck.

Figure 10:
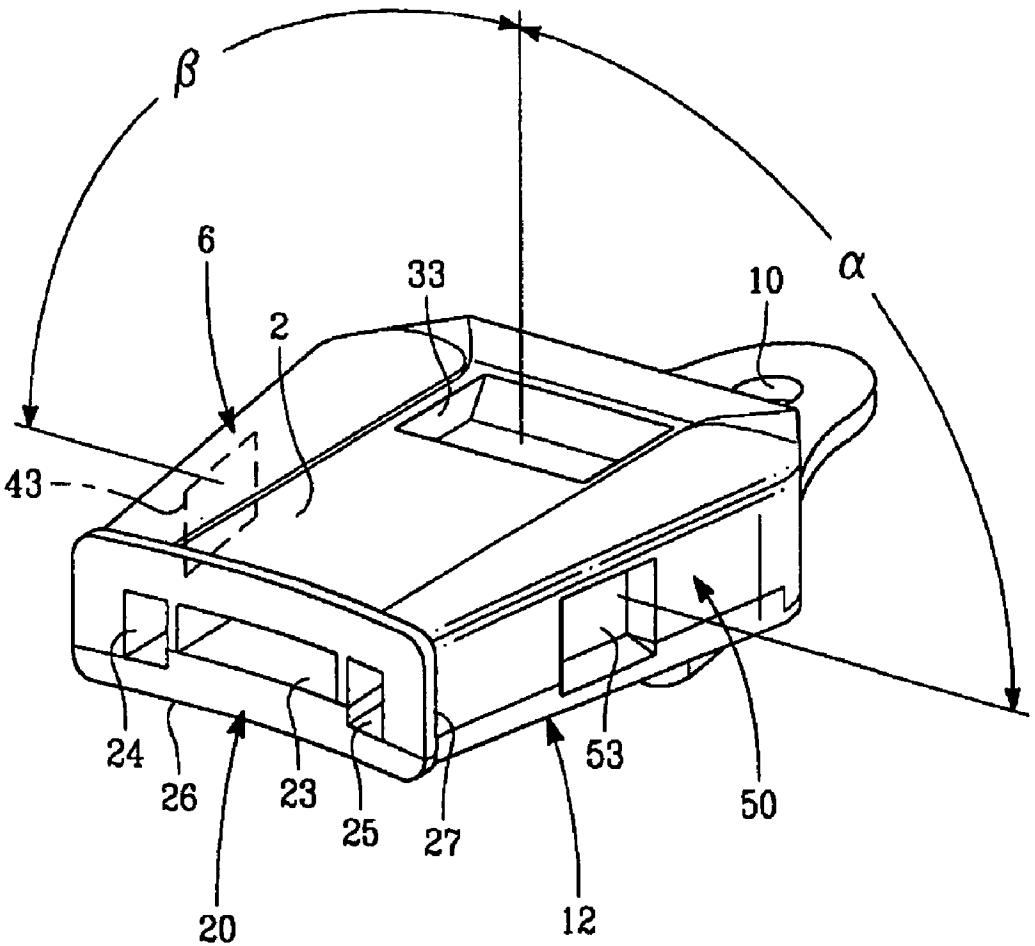
FIG. 10 is a top planar view of an alternative embodiment of a whistle in accordance with the present invention which is shorter than that shown in FIG. 1.

While the invention has been described herein with reference to a preferred embodiment, this embodiment has been presented by way of example only, and not to limit the scope of the invention. Additional embodiments thereof will be obvious to those skilled in the art having the benefit of this detailed description. In this regard, the combination of pea and pealess whistles can be changed, and the numbers of "whistles" within the hybrid whistle can be altered, so long as there are at least three whistles out of planar alignment such that the exit vents of the left and right whistles are at some angle facing away from the exit vent of one or more central exit vents in a plane perpendicular to the passageways leading to the various "whistles." In addition, it might be desirable for one of the pea or pealess whistles in one of the chambers to be set to a dog frequency, or for the whistle to be made of a plastic that glows in the dark, or for their to be detachable and interchangeable items such as a compass, thermometer and LED light that can be custom mounted to the flashlight for specific uses at specific times, all according to the desires of the end user. Also, the whistle can be shortened up without an insert as shown in FIG. 10. Further modifications are also possible in alternative embodiments without departing from the inventive concept.

Accordingly, it will be apparent to those skilled in the art that still further changes and modifications in the actual concepts described herein can readily be made without departing from the spirit and scope of the disclosed inventions as defined by the following claims.

What is claimed is:

1. A hybrid whistle having both a pealess chamber and a pea chamber, comprising:

a mouthpiece with a left air opening, a central air opening and a right air opening;

a left pealess whistle, comprising a left air passageway extending from the left air opening to a left air whistle chamber having a left air exit vent, wherein air flows from the left air opening through the left air passageway into the left air chamber and then exits the left air exit vent when the hybrid whistle is blown, thus creating a left whistle pitch sound;

a right pealess whistle, comprising a right air passageway extending from the right air opening to a right air whistle chamber having a right air exit vent, wherein air flows from the right air opening through the right air passageway into the right air chamber and then exits the right air exit vent when the hybrid whistle is blown, thus creating a right whistle pitch sound; and a central pea whistle, comprising:

a central whistle barrel chamber having a central exit vent, a pea block and a pea contained but movable within the central whistle chamber; and a central air passageway extending from the central air opening to the central whistle barrel chamber;

wherein air flows from the central air opening through the central air passageway into the central whistle barrel chamber causing the pea to circulate within the central whistle barrel chamber and then exits the central air exit vent when the hybrid whistle is blown, thus creating a central whistle pitch sound; and wherein the pea block is formed within the central whistle barrel chamber so as to modify the barrel shape of the chamber and block air flow as the pea circulates in the air current causing a staccato effect while creating enough circulating air movement to prevent the pea from getting stuck in the vent by the air as it exits out of the central air exit when the whistle is blown;

wherein the mouthpiece, the left pealess whistle, the right pealess whistle and the central pea whistle are integrally formed together with the central pea whistle being located between the left and the right pealess whistles;

wherein the left air exit vent is substantially 180 degrees opposite the right air exit vent along a plane formed perpendicularly through the central air passageway, the left air passageway and the right air passageway; and wherein the central exit vent is substantially 90 degrees away from both the left air exit vent and the right air exit vent along the plane.

2. The whistle of claim 1, wherein the left and the right whistle pitches are of a first and second pitch and the central whistle pitch is of a third pitch causing tones to beat against each other.

3. The whistle of claim 2, wherein the first and second pitches are both higher than the third pitch.

4. The whistle of claim 1, wherein the mouthpiece has a concave shape.

5. The whistle of claim 1, wherein the pea is comprised of a synthetic cork material.

6. The whistle of claim 1, further comprising:

a rubber overmolding fitted to the mouthpiece.

7. The whistle of claim 1, further comprising:

a recessed logo space molded in the whistle at a location distant from the mouthpiece on a top planar portion of the whistle.

8. The whistle of claim 7, further comprising an insert fitted to the logo space.

9. The whistle of claim 8, further comprising a bezel that encases the insert in the logo space.

10. The whistle of claim 7, further comprising:

a key-ring hole that runs through the whistle and the insert.

11. The whistle of claim 7, further comprising:

a molded underside cavity in the whistle at a second location distant from the mouthpiece on a bottom planar portion of the whistle.

12. The whistle of claim 7, further comprising a bottom insert that is fitted into and held within a molded underside cavity.

13. The whistle of claim 12, wherein the bottom insert is selected from the group comprising: a compass, a thermometer, a flashlight and a second insert containing printed subject matter.

14. The whistle of claim 1, wherein the mouthpiece, the left pealess whistle, the right pealess whistle and the central pea whistle are integrally formed together from a two piece mold construction having a top portion and a bottom portion.

15. The whistle of claim 1, further comprising a second pea whistle, comprising:

a second pea whistle barrel chamber having a second central exit vent, a second pea block and a second pea contained but movable within the second pea whistle chamber; and a second pea air passageway extending from the second pea air opening to the second pea whistle barrel chamber;

wherein air flows from the second pea air opening through the second pea air passageway into the second pea whistle barrel chamber causing the second pea to circulate within the second pea whistle barrel chamber and then exits the second pea air exit vent when the hybrid whistle is blown, thus creating a second pea whistle pitch sound; and wherein the second pea block is formed within the second pea whistle barrel chamber so as to modify the barrel shape of the second pea chamber and block the air flow as the peas circulates in the air current causing a staccato effect, while creating enough circulating air movement to prevent the pea from getting stuck in the vent by the air as it exits out of the central air exit when the whistle is blown thus creating a second pea whistle pitch sound.

16. A hybrid whistle having both a pealess chamber and a pea chamber, comprising:

a mouthpiece with a left air opening, a central air opening and a right air opening;

a left whistle, comprising a left air passageway extending from the left air opening to a left air whistle chamber having a left air exit vent, wherein air flows from the left air opening through the left air passageway into the left air chamber and then exits the left air exit vent when the hybrid whistle is blown, thus creating a left whistle pitch sound;

a right whistle, comprising a right air passageway extending from the right air opening to a right air whistle chamber having a right air exit vent, wherein air flows from the right air opening through the right air passageway into the right air chamber and then exits the right air exit vent when the hybrid whistle is blown, thus creating a right whistle pitch sound; and a central whistle, comprising a central air passageway extending from the central air opening to a central whistle chamber; wherein air flows from the central air opening through the central air passageway into the central whistle barrel chamber and then exits the central air exit vent when the hybrid whistle is blown, thus creating a central whistle pitch sound;

wherein at least one of the left whistle, the right whistle and the central whistle is a pea whistle and at least one of the left whistle, the right whistle and the central whistle is a pealess whistle;

wherein the mouthpiece, the left whistle, the right whistle and the central whistle are integrally formed together with the central whistle being located between the left and the right whistles;

wherein the left whistle pitch sound, the right whistle pitch sound and the central whistle pitch sound are all different; and wherein the left air exit vent is at a first angle directed away from the central exit vent in a plane formed perpendicularly through the central air passageway, the left air passageway and the right air passageway while the right exit vent is at a second angle directed away from the central exit vent in the plane.

17. The whistle of claim 16, wherein both the first angle and the second angle are between approximately 15 degrees and approximately 120 degrees.

18. The whistle of claim 16, wherein the mouthpiece, the left whistle, the right whistle and the central whistle are integrally formed together from a two piece mold construction having a top portion and a bottom portion.

* * * * *